US005383413A

United States Patent [19]

Hayashi

[11] Patent Number: 5,383,413

[45] Date of Patent: Jan. 24, 1995

[54] EMBROIDERY PATTERN PROCESSING APPARATUS

[75] Inventor: Kazutoshi Hayashi, Nagoya, Japan

[73] Assignee: Brother Kogyo Kabushiki Kaisha, Aichi, Japan

[21] Appl. No.: 103,661

[22] Filed: Aug. 10, 1993

[30] Foreign Application Priority Data

Sep. 7, 1992 [JP] Japan ..... 4-238554

[51] Int. Cl.[6] ..... D05B 21/00; D05C 9/04

[52] U.S. Cl. ..... 112/121.12; 112/103; 364/470

[58] Field of Search ..... 112/121.12, 103, 454, 112/457, 456, 458, 453; 364/470

[56] References Cited

U.S. PATENT DOCUMENTS 4,817,547 4/1989 Gaeumann et al. ..... 112/457
4,869,184 9/1989 Hisatake et al. ..... 112/457
5,191,536 3/1993 Komuro et al. .
5,227,977 7/1993 Hayakawa et al. .
5,231,941 8/1993 Wakayama ..... 112/121.12

*Primary Examiner*—Peter Nerbun
*Attorney, Agent, or Firm*—Oliff & Berridge

[57] ABSTRACT

An embroidery pattern processing apparatus including a reading device which reads a plurality of sets of embroidery data from a plurality of external memories, each of the sets of embroidery data defining an embroidery pattern to be formed by a sewing machine; a selection display which displays the embroidery pattern of each set of embroidery data read by the reading device; a manually operable selecting device for selecting a plurality of embroidery patterns from the embroidery patterns displayed on the selection display; and a writing device which writes, in an embroidery pattern memory, the sets of embroidery data for the embroidery patterns selected by the selecting device from the external memories.

36 Claims, 13 Drawing Sheets

EMBROIDERY PATTERN PROCESSING APPARATUS

BACKGROUND OF THE INVENTION

1. Field of the Invention

The present invention relates to an embroidery pattern processing apparatus which processes a plurality of embroidery patterns defined by a plurality of sets of embroidery data.

2. Related Art Statement

There is known an automatic sewing machine which reads, under control of a controller thereof, a set of embroidery data including X- and Y-direction feed data which in advance are prepared and stored in a recording medium such as a read only memory (ROM) card, and which machine forms an embroidery pattern into a work sheet, i.e., individual stitches by moving a sewing needle and a work sheet-supporting holder relative to each other in accordance with the X- and Y-direction feed data and concurrently vertically oscillating the sewing needle.

For forming an embroidery pattern, such as an alphabetic letter or an illustration, with the above-indicated sewing machine, an operator needs to insert a ROM card in a reading device incorporated in the sewing machine, subsequently adjust the position of the work sheet or work-sheet holder relative to the sewing needle, thereby establishing the position of sewing of the embroidery pattern on the work sheet, and operate a selecting device of the sewing machine for selecting a set of embroidery data for the embroidery pattern.

However, the conventional sewing machine is not capable of concurrently reading a plurality of sets of embroidery data from a plurality of separate ROM cards. For forming a combined embroidery patterns selected from two or more separate ROM cards, the operator first needs to finish the formation of an embroidery pattern selected from a ROM card at an established sewing position on a work sheet and subsequently form another or second embroidery pattern selected from another ROM card inserted in place of the prior ROM card after having established the sewing position of the second pattern relative to the first pattern on the work sheet. In the case where the operator wishes to form a combined embroidery patterns by alternately using two patterns respectively stored in two separate ROM cards, the operator needs to repeat the alternate insertions of the two ROM cards in the reading device of the sewing machine and repeat the work for adjusting the work sheet or work-sheet holder relative to the sewing needle and thereby establishing the sewing position of each alternate pattern on the work sheet.

Normally, a number of sets of embroidery data are stored in a single ROM card. However, some sets of embroidery data are used seldom or even never. Thus, it is time- and energy-wasting to scan all the sets of embroidery data stored in a ROM card each time a set of embroidery data which is often used is used. In addition, the conventional sewing machine is not capable of editing embroidery patterns stored in two or more separate ROM cards. When a new ROM card is inserted in the sewing machine in place of a prior ROM card, it is very difficult to determine the sewing position of a following pattern selected from the new card relative to that of a preceding pattern selected from the prior card, because the preceding pattern has been erased from a display of the selecting device. Since the sewing machine is not capable of concurrently reading sets of embroidery data from separate ROM cards, the operator needs to change the ROM cards frequently. In addition, since the sewing machine stores the selected set or sets of embroidery data in an internal memory incorporated therein, the operator needs to repeat, on a different sewing machine, the same pattern-selecting work and same sewing position-establishing work for forming the same combined embroidery patterns as the previously formed ones.

SUMMARY OF THE INVENTION

It is therefore an object of the present invention to provide an embroidery pattern processing apparatus which is operable for selecting often used embroidery patterns only from a plurality of external memories and storing the selected embroidery patterns in an embroidery pattern memory.

The above object has been achieved by the present invention. According to a first aspect of the present invention, there is provided an embroidery pattern processing apparatus comprising (a) a reading device which reads a plurality of sets of embroidery data from a plurality of external memories, each of the sets of embroidery data defining an embroidery pattern to be formed by a sewing machine, (b) a selection display which displays the embroidery pattern of the each set of embroidery data read by the reading device, (c) a manually operable selecting device for selecting a plurality of embroidery patterns from the embroidery patterns displayed on the selection display, and (d) a writing device which writes, in an embroidery pattern memory, the sets of embroidery data for the embroidery patterns selected by the selecting device from the external memories.

In the embroidery pattern processing apparatus constructed as described above, the reading device is capable of reading sets of embroidery data from two or more separate external memories, the selecting device is manually operable for selecting desired embroidery patterns only from those separate external memories, and the writing device writes, in an embroidery pattern memory, the sets of embroidery data for the embroidery patterns selected by the selecting device from the external memories. Thus, the present apparatus is operable for selecting desired embroidery patterns only from two or more separate external memories and storing the selected embroidery patterns in the embroidery pattern memory. The use of the thus obtained embroidery pattern memory in place of the separate external memories leads to shortening the time necessary for selecting desired embroidery patterns, thereby improving the work efficiency regarding the formation of the desired embroidery patterns. Even if an external memory from which the reading device reads embroidery data is changed with another external memory, the writing device is capable of writing, in the embroidery pattern memory, the sets of embroidery data selected from the prior and new external memories. Thus, the present processing apparatus is capable of processing a combined embroidery patterns selected from separate external memories.

According to a preferred feature of the present invention, the reading device reads from the external memories the each set of embroidery data comprising pattern image data representative of the embroidery pattern, and the selection display displays the embroidery pattern represented by the pattern image data of the each set of embroidery data. Alternatively, the present processing apparatus may comprise means for producing the pattern image data based on the each set of embroidery data read by the reading device. In this case, each set of embroidery data may comprise sewing control data for controlling a sewing machine to form a corresponding embroidery pattern. The sewing control data may comprise X- and Y-direction feed data for the relative movements of a sewing needle and a work sheet-supporting holder of the sewing machine for forming the embroidery pattern.

According to another feature of the present invention, the reading device comprises a plurality of memory holders each of which holds a corresponding one of the external memories such as a read-only-memory card. In this case, it is possible to concurrently read a plurality of sets of embroidery data from a plurality of separate external memories, without having to replace the external memories with one another. Thus, the present processing apparatus is capable of selecting desired embroidery patterns in shorter time and with higher work efficiency.

According to yet another feature of the present invention, the reading device comprises a memory holder which holds one of the external memories, and a memory which stores the sets of embroidery data read by the reading device from the one of the external memories. In this case, even if the reading device has only one memory holder, the reading device is capable of reading sets of embroidery data from two or more external memories, and the writing device writes in the embroidery pattern memory the sets of embroidery data for the embroidery patterns selected by the selecting device from the two or more external memories.

According to yet another feature of the present invention, the writing device comprises a memory holder which holds as the embroidery pattern memory an external memory such as a random-access-memory card, and the writing device writes in the external memory the sets of embroidery data selected by the selecting device. In this case, the selected sets of embroidery data stored in the external memory can be used two or more times, and can be used with different sewing machines each having a data reading device for reading the embroidery data from the external memory.

According to a further feature of the present invention, the selecting device comprises a pressure-sensitive panel provided on the selection display, the panel permitting an operator to see, through the panel, the embroidery patterns displayed on the selection display and enabling the operator to select one of the displayed embroidery patterns by pressing a corresponding portion of the panel.

In a preferred embodiment of the present invention, the processing apparatus further comprises a manually operable editing device for editing the embroidery patterns selected by the selecting device from the external memories. The editing device may comprise an editing display which displays the embroidery patterns selected by the selecting device from the external memories; a cursor which is displaceable on the editing display to designate a position where a selected embroidery pattern is to be located; and a manually operable cursor-displacing member for displacing the cursor on the editing display.

According to another feature of the present invention, the writing device writes, in the embroidery pattern memory, sets of position data indicative of the positions where the embroidery patterns selected by the selecting device are located on the editing display, in addition to the sets of embroidery data for the selected embroidery patterns. The editing display may display the embroidery patterns represented by the sets of embroidery data written in the embroidery pattern memory, at the respective positions indicated by the sets of position data written in the embroidery pattern memory.

According to yet another feature of the present invention, the editing device further comprises a manually operable pattern-erasing member for erasing, from the embroidery pattern memory, a set of embroidery data for a specified one of the embroidery patterns displayed on the editing display. The editing device may further comprise a manually operable pattern-replacing member for replacing, in the embroidery pattern memory, a set of embroidery data for a specified one of the embroidery patterns displayed on the editing display, with a set of embroidery data for an embroidery pattern selected by the selecting device from the embroidery patterns displayed on the selection display. The editing device may further comprise a manually operable pattern-displacing member for displacing a specified one of the embroidery patterns displayed at the position thereof on the editing display, to a desired, new position on the editing display.

According to a further feature of the present invention, the editing display comprises a number of unit display areas, and the cursor designates one of the unit display areas. The editing device may comprise a manually operable changing device for changing a size of an embroidery pattern selected by the selecting device from the embroidery patterns displayed on the selection display, the editing display displaying the selected embroidery pattern in the changed size thereof. The .editing device may comprise adjusting means for, when a size of an embroidery pattern selected by the selecting device is greater than a size of the unit display area designated by the cursor, displacing the cursor to a position where the selected embroidery pattern is displayed in the size thereof on the editing display without overlapping any embroidery patterns displayed on the editing display.

According to a second aspect of the present invention, there is provided a sewing system comprising (A) an embroidery pattern processing apparatus including (a) a reading device which reads a plurality of sets of embroidery data from a plurality of external memories, each of the sets of embroidery data defining an embroidery pattern, (b) a selection display which displays the embroidery pattern of the each set of embroidery data read by the reading device, (c) a manually operable selecting device for selecting a plurality of embroidery patterns from the embroidery patterns displayed on the selection display, (d) a writing device which writes, in an embroidery pattern memory, the sets of embroidery data for the embroidery patterns selected by the selecting device from the external memories; and (B) a sewing machine which forms the selected embroidery patterns according to the sets of embroidery data written in the embroidery pattern memory.

BRIEF DESCRIPTION OF THE DRAWINGS

The above and optional objects, features and advantages of the present invention will be better understood by reading the following detailed description of the presently preferred embodiments of the invention when considered in conjunction with the accompanying drawings in which.

DETAILED DESCRIPTION OF THE PREFERRED EMBODIMENTS

Figure 1:
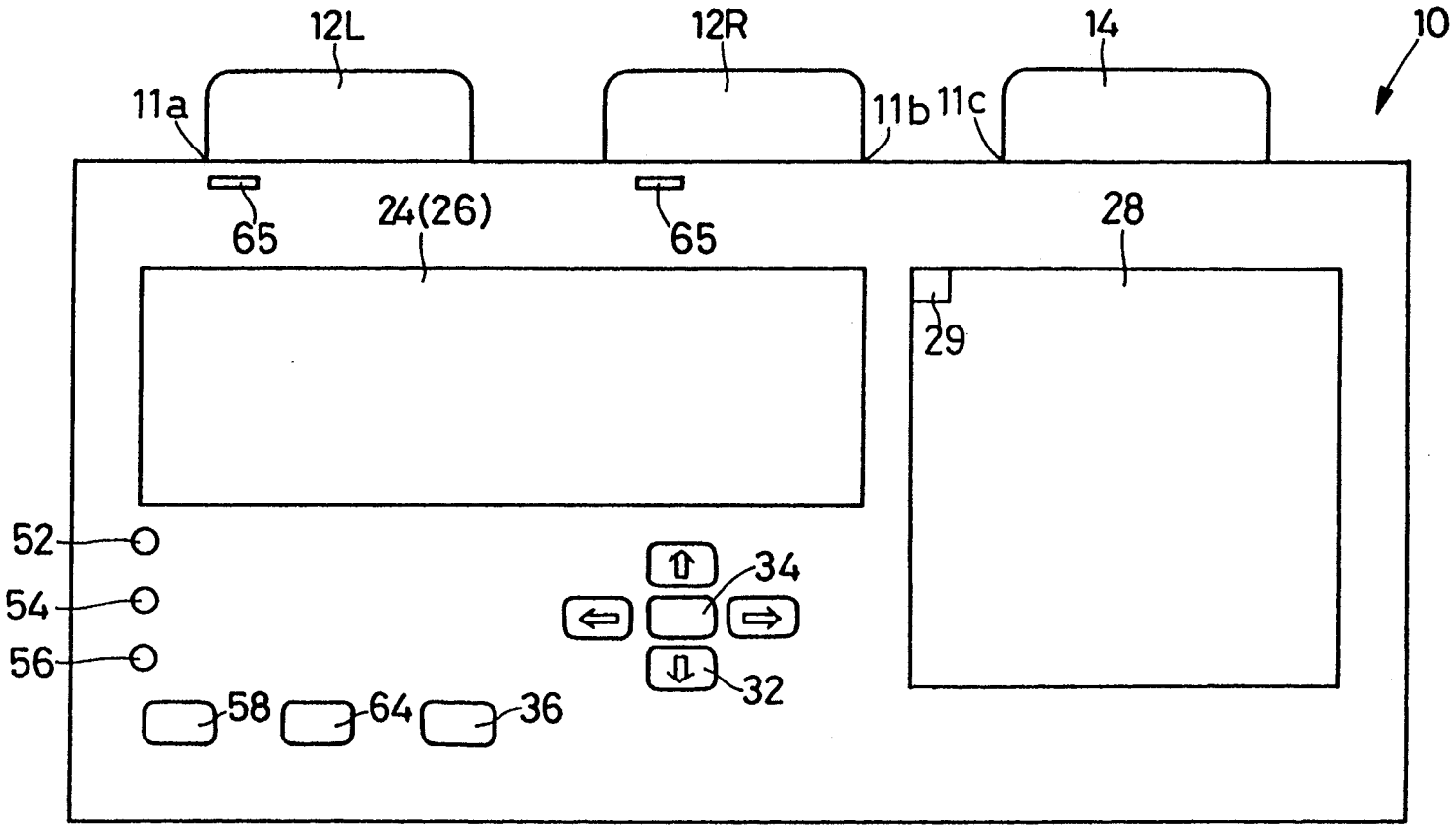
FIG. 1 is a plan view of an embroidery pattern editing apparatus embodying the present invention.
Figure 2:
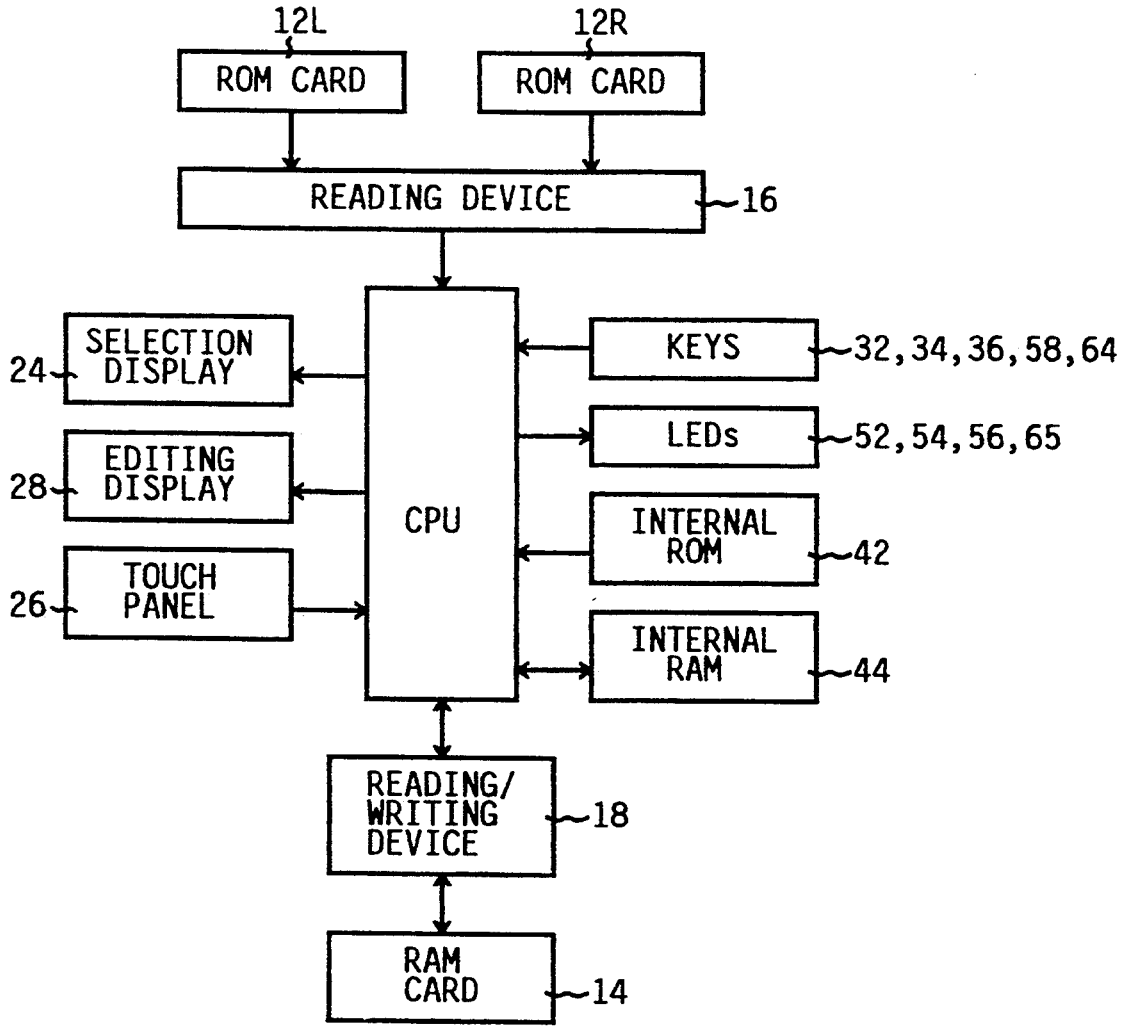
FIG. 2 is a block diagram showing the construction of the editing apparatus of FIG. 1.

Referring first to FIGS. 1 and 2, there is shown an embroidery pattern editing apparatus 10 embodying the present invention. The editing apparatus 10 has a box-like configuration.

The editing apparatus 10 has a first, a second and a third card holder 11*a*, 11*b*, 11*c* each of which has, at the rear part of the apparatus 10, an opening for receiving an external memory in the form of a card. In the present embodiment, each of the first and second card holders 11*a*, 11*b* is adapted to hold a read-only-memory (ROM) card 12 (12L, 12R), and the third card holder 11*c* is adapted to hold a random-access-memory (RAM) card 14.

The editing apparatus 10 incorporates a reading device 16 having a first input part (not shown) connectable with an output part of the ROM card 12L held in the first card holder 11*a*, and a second input part (not shown) connectable with an output part of the ROM card 12R held in the second card holder 11*b*. In addition, the editing apparatus 10 incorporates a reading/writing device 18 including an input and an output part (not shown) connectable with an output and an input part of the RAM card 14 held in the third card holder 11*c*. The reading device 16 is capable of reading data from any storage area of either one of the two ROM cards 12L, 12R held by the two card holders 11*a*, 11*b*, while the reading/writing device 18 is capable of reading data from, and writing data in, any storage area of the RAM card 14 held by the third card holder 11*c*. The reading device 16 and the reading/writing device 18 are connected to a central processing unit (CPU) 22 which controls the operation of the editing apparatus 10 as a whole.

The editing apparatus 10 has a selection display 24, such as a liquid-crystal display, provided in the top surface of the apparatus 10. The selection display 24 is connected to the CPU 22, and is capable of displaying embroidery patterns respectively represented by sets of embroidery data stored in the ROM card 12L, 12R. The top surface of the selection display 24 is covered with a pressure-sensitive panel 26 which permits an operator to see, through the thickness of the panel 26, the embroidery patterns displayed on the selection display 24. The pressure-sensitive panel 26 contains a multiplicity of pressure-sensitive switches which are distributed over the entire area of the panel 26 and each are connected to the CPU 22. Thus, the panel 26 supplies the CPU 22 with a detection signal indicative of a specific position or area on the display 24, when the switch or switches located at the specific position or area is/are pressed or touched e.g., operator's finger. Since the embroidery patterns stored in the ROM card 12L, 12R are displayed under control of the CPU 22 on the selection display 24, such that the displayed patterns are associated with respective positions or areas on the display 24, the operator can select a desired pattern from the patterns displayed on the display 24, by pressing a corresponding position or portion of the panel 26 with his or her finger. It is noted that the editing apparatus 10 is capable of reading data from the ROM cards 12L, 12R which may also be used directly with a sewing machine, and is capable of writing data in the RAM card 14 which may also be used directly with a sewing machine, and that the editing apparatus 10 employs the selection display 24 and touch panel 26 both of Which may be employed in a sewing machine. Thus, the editing apparatus 10 utilizes some common parts with sewing machines. If the operator is familiar with the selection display 24 and touch panel 26 because he or she often uses them on sewing machines, then he or she can easily select desired embroidery patterns on the editing apparatus 10.

Also on the top surface of the editing apparatus 10, there is provided a square, editing display 28 adjacent to the selection display 24. The editing display 28 defines the positional relationship on a work sheet to be sewn. The editing display 28 is connected to the CPU 22, and is capable of temporarily displaying one or more embroidery patterns selected through operator's manual operation of the touch panel 26 on the selection display 24, and displaying one or more embroidery patterns represented by the set or sets of embroidery data stored in the RAM card 14 held by the third card holder 11*c*. The editing display 28 indicates a cursor 29 for designating a position (i.e., "unit area" in the present embodiment) where a following embroidery pattern selected by the operator is to be located or displayed. The operator can choose a desired size of a selected embroidery pattern, by pressing an appropriate portion of the touch panel 26. For example, regarding the example shown in FIG. 9, before an alphabetic capital letter, "H", as an embroidery pattern is selected by pressing a corresponding portion of the panel 26, the operator presses an appropriate portion of the panel 26 corresponding to a desired one of "L" (large), "M" (medium), and "S" (small) sizes displayed on the selection display 24, so that on the editing display 28 the selected pattern "H" is displayed in the selected size.

On the top of the editing apparatus 10, there are also provided four cursor-displacing keys 32 in front of the selection display 24. The four keys 32 have respective arrows on the top surfaces thereof, and are used for displacing, on the editing display 28, the cursor 29 in four directions, i.e., upward, downward, leftward, and rightward corresponding to the respective directions indicated by the arrows on the keys 32. A decision key 34 is provided on the top of the editing apparatus 10, with being surrounded by the four cursor-displacing keys 32. When the decision key 34 is operated or depressed in each of three editing modes (described later) of the apparatus 10, the decision key 34 generates a decision signal to the CPU 22.

Also on the top of the editing apparatus 10, there is provided an all-pattern erasing key 36 on the left-hand side of the cursor-displacing keys 32. When the all-pattern erasing key 36 is operated in a pattern erasing mode (described later) of the apparatus 10, the key 36 generates to the CPU 22 a command signal to command the CPU 22 to erase all the data stored in the RAM card 14 held by the third card holder 11*c*. The editing apparatus 10 has a power switch (not shown) which is operable by the operator for supplying electric power to, or cutting it from, the apparatus 10.

The CPU 22 has well-known computing and timer functions in accordance with control programs stored in an internal read only memory (ROM) 42. In addition, according to the present invention, the CPU 22 has the editing function including (i) combining embroidery patterns (or combining sets of embroidery data) selected from two or more ROM cards 12 (12L, 12R) and (ii) revising the layout of the combined embroidery patterns. As shown in FIG. 2, the CPU 22 receives the input signals from the touch panel 26 and the various keys 32, 34, 36 (also keys 58 and 64 described later), and generates control signals to the selection display 24, editing display 28, reading device 16, and reading/writing device 18. The CPU 22 is connected to the internal ROM 42, and also to an internal random access memory (RAM) 44. The internal ROM 42 stores, in advance, various values and programs necessary for the editing function. The internal RAM 44 temporarily stores various values computed by the CPU 22, and sets of pattern image data representing embroidery patterns displayed on the selection or editing display 24, 28. Additionally, the internal RAM 44 temporarily stores the embroidery data read by the reading device 16 from the ROM cards 12L, 12R. Therefore, even if one or both of the ROM cards 12L, 12R is/are removed from the editing apparatus 10, the CPU 22 can effect the editing function.

Further, on the top of the editing apparatus 10, there are provided a first, a second, and a third mode light emitting diodes (LED) 52, 54, 56 arranged in an array on the left-hand side of the cursor-displacing keys 32. The three mode LEDs 52, 54, 56 are lighted one by one, by switching, in the order of description (52→54→56→52→. . . ), in response to operations of a mode-selecting key 58. When the mode-selecting key 58 is operated by the operator, the key 58 generates to the CPU 22 an electric signal indicative of that operation, thereby placing the editing apparatus 10 in a corresponding one of the three editing modes, i.e., pattern combining mode, pattern specifying mode, and pattern erasing mode (described later). The three mode LEDs 52, 54, 56 correspond to the pattern combining mode, pattern specifying mode, and pattern erasing mode, respectively. Lighting of one of the mode LEDs 52, 54, 56 indicates that the editing apparatus 10 is currently placed in the corresponding editing mode.

On the top of the editing apparatus 18, there is provided a ROM card-selecting key 64 between the all-pattern erasing key 36 and the mode-selecting key 58. The card-selecting key 64 is connected to the CPU 22. Upon operation of the card-selecting key 64, the key 64 generates to the CPU 22 an electric signal indicative of that operation, and one of the two ROM cards 12L and 12R is selected so that the embroidery patterns stored in the selected ROM card 12L or 12R are displayed on the selection display 24. Each of the first and second card holders 11*a*, 11*b* has a card LED 65 on the top surface of the apparatus 10. Lighting of one of the two card LEDs 65, 65 indicates that the embroidery patterns stored in the corresponding ROM card 12L or 12R are currently displayed on the selection display 24. The two card LEDs 65, 65 are alternately lighted in response to respective operations of the card-selecting key 64.

Figure 3:
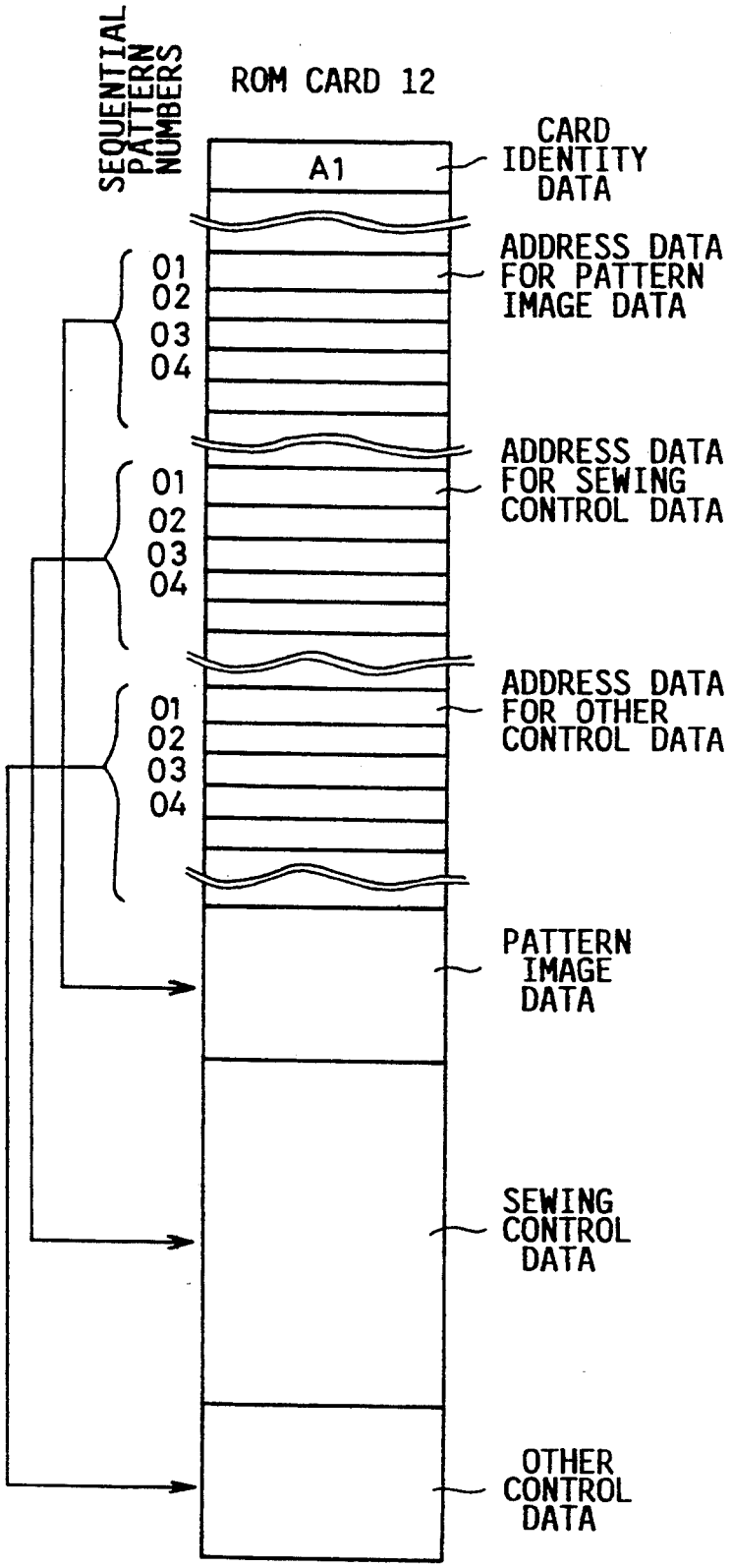
FIG. 3 is a view explaining the manner of storage of data in a ROM card with which the editing apparatus of FIG. 1 is used.
Figure 4:
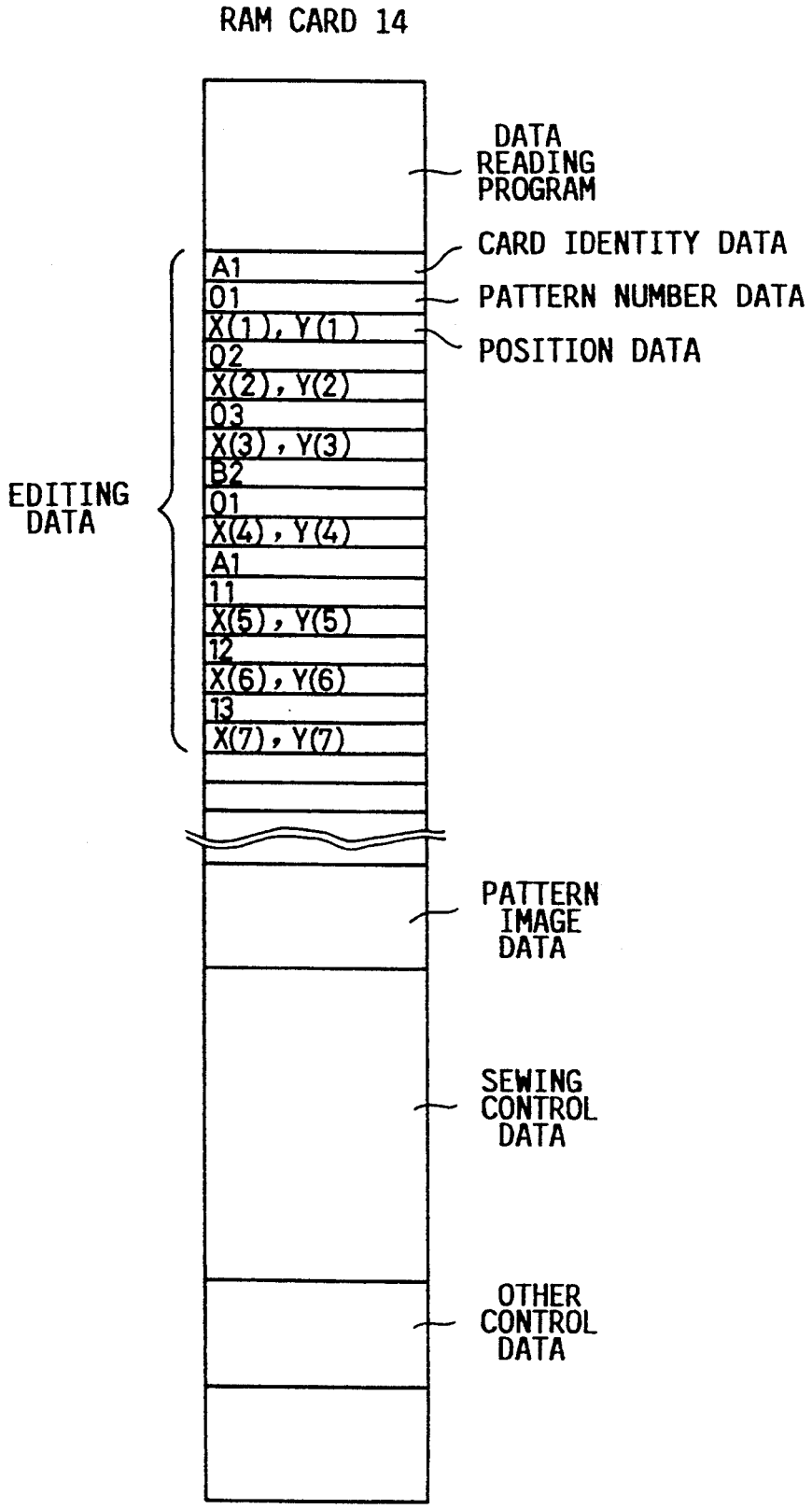
FIG. 4 is a view explaining the manner of storage of data in a RAM card with which the editing apparatus of FIG. 1 is used.

Referring next to FIGS. 3 and 4, there will be described the manner of storage of data in the ROM card 12 (12L, 12R) and the manner of storage of data in the RAM card 14.

The data stored in the ROM card 12 comprise card identity data including sort data indicative of the sort or kind (e.g., alphabetic letter, illustration, numeral, etc.) of the stored embroidery patterns, and class data indicative of a specific class in that sort of the stored embroidery patterns. In FIG. 3, the sort data is indicated by an alphabetic capital letter, A, B, C, . . . , while the class data is indicated by a numeral, 1, 2, 3, . . . . Thus, the identity data of the ROM card 12 is indicated by a combination of a capital letter and a numeral, for example, "A1".

The data stored in the ROM card 12 further comprise, for a single embroidery pattern, a set of embroidery data including pattern image data, sewing control data, and other control data. The embroidery patterns, or sets of embroidery data for the patterns, stored in the ROM card 12 are associated with sequential pattern numbers, 00, 01, 02, . . . , in the order of storage in the card 12. The pattern image data comprise numeric data representative of an embroidery pattern to be displayed on the selection or editing display 24, 28. The sewing control data comprise numeric data for controlling a sewing machine to move a sewing needle and a work sheet, such as fabric or leather, relative to each other so as to form the embroidery pattern into the work sheet. The other control data than sewing control data comprise numeric data necessary for controlling a sewing machine as a whole during the sewing operation. The data stored in the ROM card 12 further comprise three batches of address data indicative of respective addresses where the pattern image data, sewing control data, and other control data of each set of embroidery data are stored in the ROM card 12.

As shown in FIG. 3, the ROM card 12 stores, following the card identity data indicated by, e.g., "A1", three batches of address data, i.e., batch of address data for the pattern image data, batch of address data for the sewing control data, and batch of address data for the other control data. In each of the three address-data batches, sets of address data are stored in the order of storage of the sets of embroidery data, i.e., in the order of sequential pattern numbers of the same. The ROM card 12 stores, following the three batches of address data, three batches of pattern-related data, i.e., batch of pattern image data, batch of sewing control data, and batch of other control data, in the order of description. In each of the three pattern-related-data batches, sets of pattern image data, sewing control data, or other control data are stored in the order of sequential pattern numbers at the respective addresses indicated by the corresponding batch of address data.

The manner of storage of data in the RAM card 14 is different from the above-described manner of storage of data in the ROM card 12. During the editing operation of the apparatus 10, data are stored in the RAM card 14. An exclusive data-reading program is necessary for reading data from the RAM card 14. Additionally, editing data are necessary for editing embroidery patterns selected and stored in the RAM card 14. The editing data comprise card identity data identifying a pertinent ROM card 12 from which each selected embroidery pattern is read, and data indicative of a sequential pattern number with which each selected embroidery pattern is associated in that pertinent ROM card 12. The editing data further comprise position data indicative of a reference position where each selected embroidery pattern is located on the editing display 28, i.e., on the work sheet. For example, FIG. 4 shows editing data, stored in the RAM card 14, for an embroidery pattern which is associated with a sequential pattern number, 01, in the ROM card 12 having identity data, A1, and is located at a reference position, (X(1), Y(1)), on the editing display 28. In the present embodiment, a single embroidery pattern may be associated with two or more sequential pattern numbers in the ROM card 12, and may be associated with two or more reference positions on the editing display 28 in the RAM card 14. In this case, the single pattern may be regarded as consisting of two or more sub-patterns.

As shown in FIG. 4, the RAM card 14 stores, in the head portion thereof, the above-described data reading program. The RAM card 14 stores, following the data reading program, editing data for editing sets of embroidery data selected from the ROM cards 12 (12L, 12R), in the order of selection or edition thereof. Further, the RAM card 14 stores a batch of pattern image data, a batch of sewing control data, and a batch of other control data in the order of description. In each of the three pattern-related-data batches, sets of pattern image data, sewing control data, or other control data are stored in the order of selection or edition thereof.

The RAM card 14 has an exclusive electric power source, such as a small-size battery, which is independent of the editing apparatus 10. Therefore, even after the power switch (not shown) has been operated for cutting electric power from the editing apparatus 10, the RAM card 14 maintains the data stored therein by the editing operation of the apparatus 10. Additionally, the output part of the RAM card 14 is of the same construction as that of the ROM card 12, therefore the RAM card 14 may be used directly with a sewing machine having a reading device for reading data from the ROM card 12. The RAM card 14 has a great storage capacity sufficient to store plural batches of combined embroidery data each batch of which represents combined embroidery patterns which can simultaneously be displayed on the editing display 28.

In the present embodiment, the ROM cards 12 correspond to at least one external memory. The touch panel 26 serves as a manually operable selecting device, and the reading/writing device 18 serves as a writing device. The RAM card 14 corresponds to an embroidery pattern memory.

Figure 11:
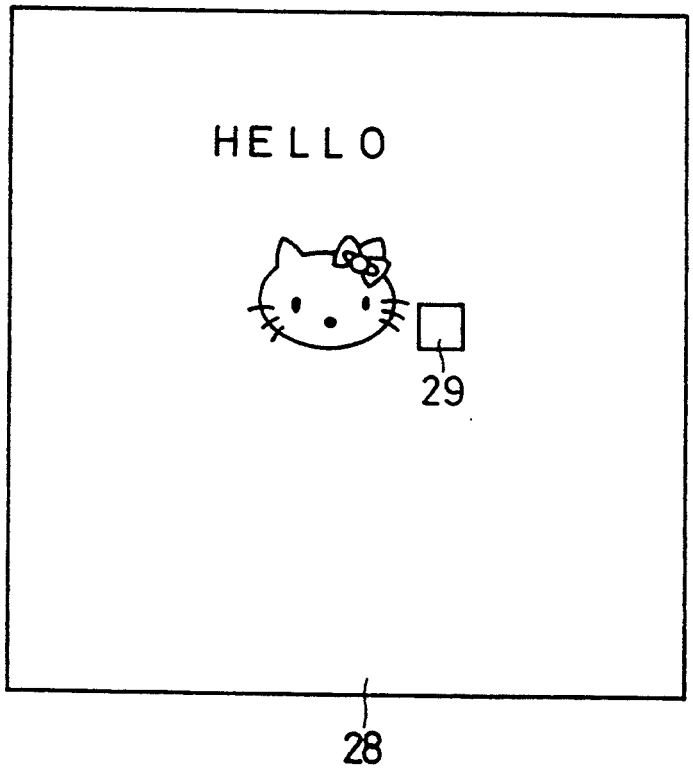
FIG. 11 is yet another view explaining the manner of editing the combined embroidery patterns on the editing display.

Referring next to the flow charts of FIGS. 5 to 8, there will be described the operation of the present editing apparatus 10 for processing a combined embroidery patterns as shown in FIG. 11.

In the event that the combined embroidery patterns shown in FIG. 11 are processed by the present apparatus 10, first, a ROM card 12L storing alphabetic letters and a ROM card 12R storing various illustrations are inserted into the first and second card holders 11*a*, 11*b* of the apparatus 10, respectively.

Figure 9:
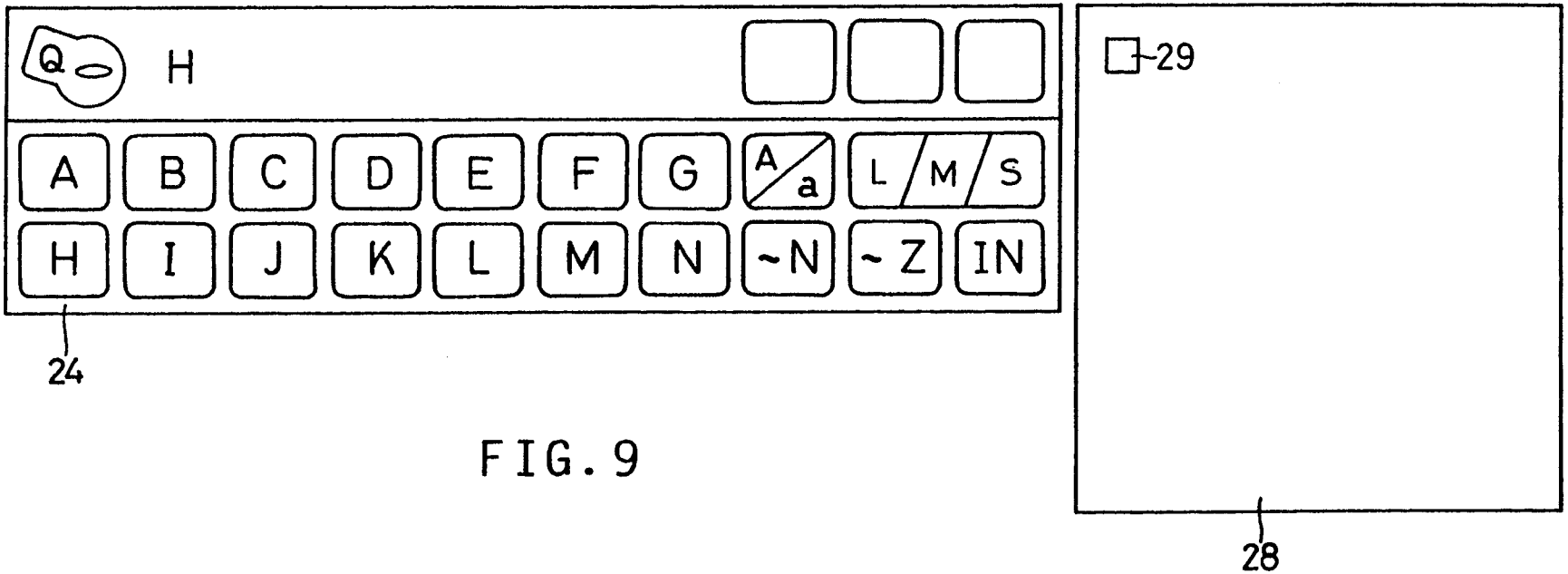
FIG. 9 is a view explaining the manner of editing a combined embroidery patterns on an editing display of the editing apparatus of FIG. 1.
Figure 10:
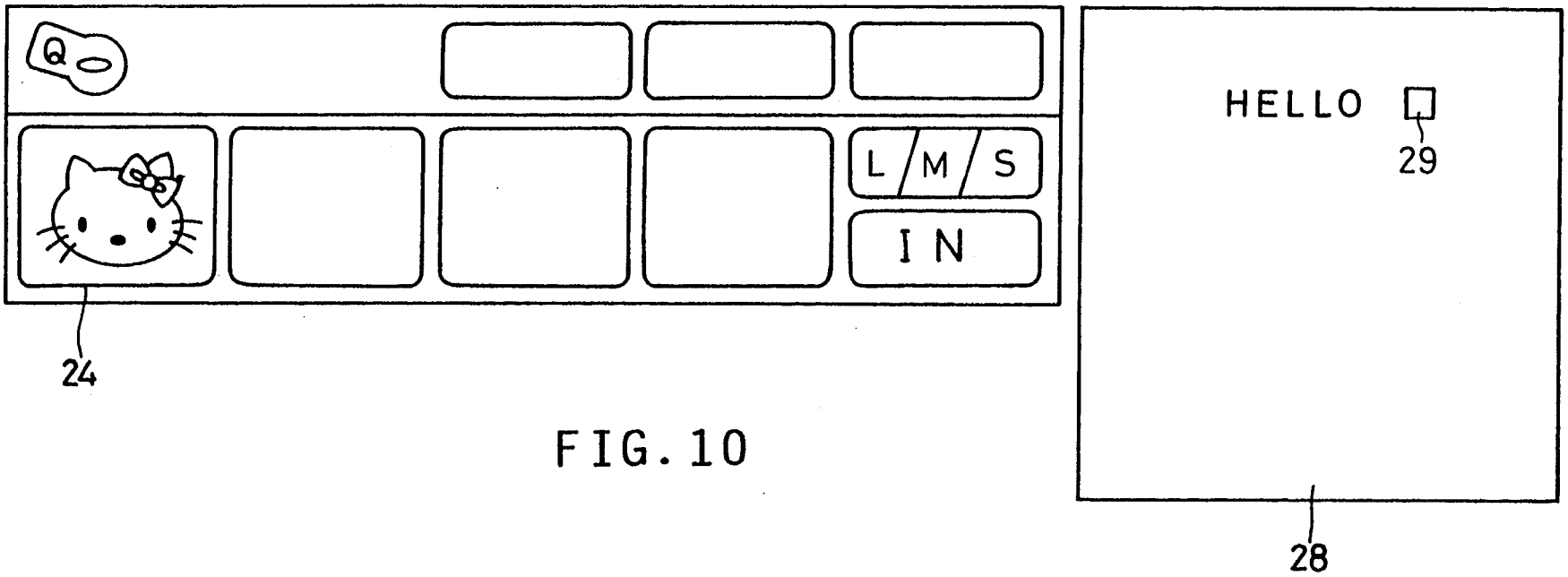
FIG. 10 is another view explaining the manner of editing the combined embroidery patterns on the editing display.

Upon application of electric power to the editing apparatus 10 by operation of the power switch (not shown), the reading device 16 identifies, using two detectors (not shown), that each of the first and second card holders 11*a*, 11*b* has accommodated a ROM card 12. Subsequently, the reading device 16 automatically reads the sets of embroidery data from the right-hand ROM card 12R held in the second card holder 11*b* and, as shown in FIG. 9, the CPU 22 operates for displaying, on the selection display 24, the embroidery patterns represented by the sets of pattern image data included in the sets of embroidery data read from the right-hand ROM card 12R. In the present embodiment, the reading device 16 is adapted to first read, following the application of electric power to the apparatus 10, data from the ROM card 12R held by the second card holder 11*b*. However, when the reading device 16 cannot identify that the second card holder 11*b* has accommodated a ROM card 12, the reading device 16 automatically reads the sets of embroidery data from the left-hand ROM card 12L held in the first card holder 11*a* and, as shown in FIG. 10, the CPU 22 operates for displaying, on the selection display 24, the embroidery patterns read from the left-hand ROM card 12L. On the other hand, when the reading device 16 identifies that neither the first nor second card holder 11*a*, 11*b* has accommodated a ROM card 12, the CPU 22 operates for displaying, on the display 24, an indication informing the operator of that situation.

Meanwhile, when the ROM card-selecting key 64 is operated, or when one of the two ROM cards 12L, 12R whose data are currently displayed on the selection display 24 is removed from the corresponding card holder 11*a*, 11*b*, the reading device 16 reads data from the other ROM card 12L, 12R held in the other card holder 11*a*, 11*b*, and the CPU 22 operates for displaying, on the selection display 24, the patterns read from the other ROM card 12L, 12R. Simultaneously, the CPU 22 lights the other card LED 65 corresponding to the other card holder 11*a*, 11*b*. Although, in FIG. 9, only the first half alphabetic letters, A to N, are displayed on the display 24, the second half letters, O to Z, can be displayed by pressing an appropriate portion (corresponding to symbol "~N") Of the touch panel 26. In addition, while in FIG. 9 only capital letters are displayed, small letters can be displayed by pressing an appropriate portion (corresponding to one of symbols "A/a") of the panel 26. Further, the size of a selected pattern can be changed by pressing an appropriate portion (corresponding to one of symbols "L/M/S") of the panel 26.

When a RAM card 14 is inserted into the third card holder 11*c*, the reading/writing device 18 identifies, using a detector (not shown), that the third card holder 11*c* has accommodated the RAM card 14. Subsequently, the reading/writing device 18 scans the data stored in the head portion of the RAM card 14, for identifying whether or not the above-described data reading program is stored therein and, when the data reading program is not found in the RAM card 14, the CPU operates for reading the data reading program from the internal ROM 42 and storing it in the RAM card 14. Meanwhile, when no embroidery data is found in the RAM card 14, the CPU 22 operates for displaying, on the editing display 28, an indication informing the operator of that situation. On the other hand, when one or more sets of embroidery data is/are found in the RAM card 14, the reading/writing device 18 reads the embroidery data from the RAM card 14, and the CPU 22 operates for displaying, on the editing display 28, the embroidery pattern or patterns represented by the set or sets of pattern image data included in the set or sets of embroidery data read from the RAM card 14. It is noted that the reading device 16 and the reading/writing device 18 concurrently carry out the above-described respective operations and repeat those operations during the editing operation described below.

Figure 5:
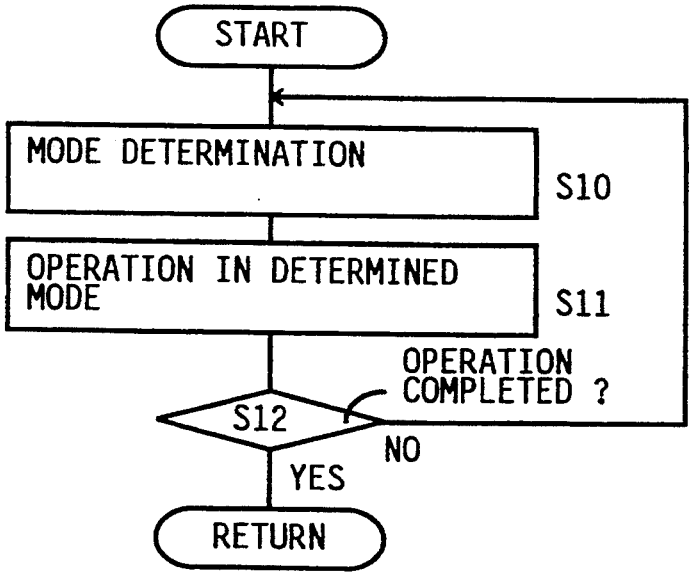
FIG. 5 is a flow chart representing the main routine of the editing operation of the editing apparatus of FIG. 1.

After the CPU 22 operates for displaying the data stored in the RAM card 14 on the editing display 28, the CPU 22 proceeds with the main routine of the editing operation of the apparatus 10 which routine is represented by the flow chart of FIG. 5.

First, the CPU 22 implements Step S10 of FIG. 5 and, if it is the first implementation following the application of electric power to the apparatus 10, the CPU 22 places the apparatus 10 in the pattern combining mode as one of the three editing modes of the apparatus 10. Then, the control of the CPU 22 proceeds with Step S11 to operate the apparatus 10 in the pattern combining mode according to the sub-routine of FIG. 6. At Step 20 of FIG. 6, the CPU 22 identifies whether or not there is an embroidery pattern which has been specified in the pattern specifying mode represented by the sub-routine of FIG. 7. Provided that no embroidery data be stored in the RAM card 14 held in the third card holder 11*c* of the apparatus 10, the CPU 22 makes a negative decision at Step S20. This result is stored in the internal RAM 44.

Subsequently, the control of the CPU 22 goes to Step S21 to display the cursor 29 flickering on the editing display 28. Since no embroidery data is stored in the RAM card 14, the cursor 29 is located at the initial position, i.e., the left top corner of the square display 28, as shown in FIG. 9. Step S21 is followed by Step S23 at which the CPU 22 waits for the operator to select a desired one of the embroidery patterns displayed on the selection display 24 by pressing a corresponding portion of the touch panel 26. Meanwhile, the operator may displace the cursor 29 to a desired position on the display 28 (which corresponds a desired position on the work sheet) by operating one or more of the four cursor-displacing keys 32.

For example, regarding the example of FIG. 11, the cursor 29 is displaced rightward and downward, and a capital letter, "H" (head of the word "HELLO"), is specified by pressing a corresponding portion of the panel 26 on the selection display 24. Subsequently, when the operator presses a portion of the panel 26 corresponding to symbol "IN" displayed on the selection display 24, the CPU 22 reads the set of embroidery data for the pattern "H" and stores the data in the internal RAM 44 for displaying the pattern "H" at the position designated by the cursor 29 on the editing display 28.

When a positive decision is thus made in Step S23, the control of the CPU 22 goes to Step S24 to judge whether or not it is possible to display the pattern selected at Step S23 at the position designated by the cursor 29, inside the whole area of the display 28 and without overlapping other embroidery patterns displayed on the display 28. In the present embodiment, the editing display 28 is comprised of a number of unit display areas, and the cursor 29 designates one of the unit display areas. The unit display area corresponds to, e.g., the small size, i.e., "S" out of the three sizes "L/M/S" displayed on the selection display 24. Provided that the pattern "H" be selected in the "S" size, the CPU 22 makes a positive judgment at Step S24. On the other hand, when a negative judgment is made at Step S24, the control of the CPU 22 goes to Step S25 to determine adjustment amounts or values to displace the position of the cursor 29 to a reference position where the selected embroidery pattern in the selected size can be displayed inside the editing display 28 and without overlapping other patterns in the display 28. The determined adjustment amounts are stored in the internal RAM 44. In the case where the size of a selected pattern is different from that of the cursor 29, i.e., greater than unit display area, the center of the selected pattern is utilized as the reference position of the pattern to be designated by the cursor 29. The position data indicative of the reference position where a selected pattern is located on the editing display 28, is prepared and stored in the internal RAM 44 in association with the set of embroidery data for the selected pattern.

Step S25 is followed by Step S26 to display and flicker, on the editing display 28, the pattern selected at Step S23, at the position designated by the cursor 29 with or without the adjustment effected at Step S25. Step S26 is followed by Step S27 at which the CPU 22 waits for the operator to operate the decision key 34 to store, in the RAM card 14, the set of embroidery data for the pattern currently flickering on the editing display 28. When the operator depresses the decision key 34 and the CPU 22 makes a positive judgment at Step S27, the control of the CPU 22 goes to Step S28 to read the result of the judgment at Step S20 from the internal RAM 44 and, if the judgment at Step S20 is negative, store in the RAM card 14 the set of embroidery data for the selected pattern. More specifically, the editing data, pattern image data, sewing control data, and other control data included in the selected set of embroidery data, are stored in respective storage areas or addresses in the RAM card 14. Additionally, at Step S28, the CPU 22 prepares and stores in the internal RAM 44 position data indicative of a reference position to be next designated by the cursor 29, i.e., position rightward adjacent to the reference position where the preceding pattern is located. When the editing display 28 has no remaining area on the right-hand side of the preceding pattern, the CPU 22 stores position data for a reference position which is upward, downward, or leftward adjacent to the preceding pattern.

After the above-indicated data storing operation, the CPU 22 stops the flickering of the pattern whose embroidery data have been stored in the RAM card 14, i.e., displays the still image of the pattern on the editing display 28 according to the embroidery data stored in the RAM card 14. Then, the control of the CPU 22 goes back to the main routine of FIG. 5. Before the operator operates the decision key 34 at Step S27, the operator may operate the all-pattern erasing key 36 to cancel the selection of the flickering pattern, i.e., storage of the embroidery data in the RAM card 14. In this case, the control of the CPU 22 goes back to Step S20 to enable the operator to select a new pattern in place of the canceled pattern.

Unless the mode-selecting key 58 is operated, the editing apparatus 10 continues to be placed in the pattern combining mode. In the current cycle, at Step S20, the CPU 20 again makes a negative judgment, and at Step S21 the CPU 20 displays the cursor 29 at the reference position, i.e., rightward adjacent to the preceding pattern (e.g., "H" in the example of FIG. 11) indicated by the position data stored in the internal RAM 44 at Step S28 in the preceding cycle. Regarding the example of FIG. 11, the pattern "E" is next selected at Step S23, and the embroidery data for the pattern "E" are stored at Step S28 after implementations at Steps S24 through S27. After similar operations are repeated according to the sub-routine of FIG. 6, the combined sets of embroidery data for the combined patterns "HELLO" are stored in the RAM card 14, and the word "HELLO" is displayed on the editing display 28 as shown in FIG. 10. Although in the present embodiment embroidery patterns are selected one by one at Step S23, it is possible to adapt the sub-routine of FIG. 6 to enable the operator to select and combine two or more patterns (e.g., "HELLO") on the selection display 24 and transfer the combined patterns from the selection display 24 to the editing display 28, at once.

Meanwhile, if the operator notices that he or she has stored an erroneously combined patterns (e.g., misspelled word "HALLO") in the RAM card 14, the operator first operates the mode-selecting key 58 to place the editing apparatus 10 in the pattern specifying mode. In this event, at Step S10 of FIG. 5, the CPU 22 identifies that the editing apparatus 10 is currently placed in the pattern specifying mode, and at Step S11 the CPU 22 implements the sub-routine of FIG. 7 for the pattern specifying mode.

Figure 7:
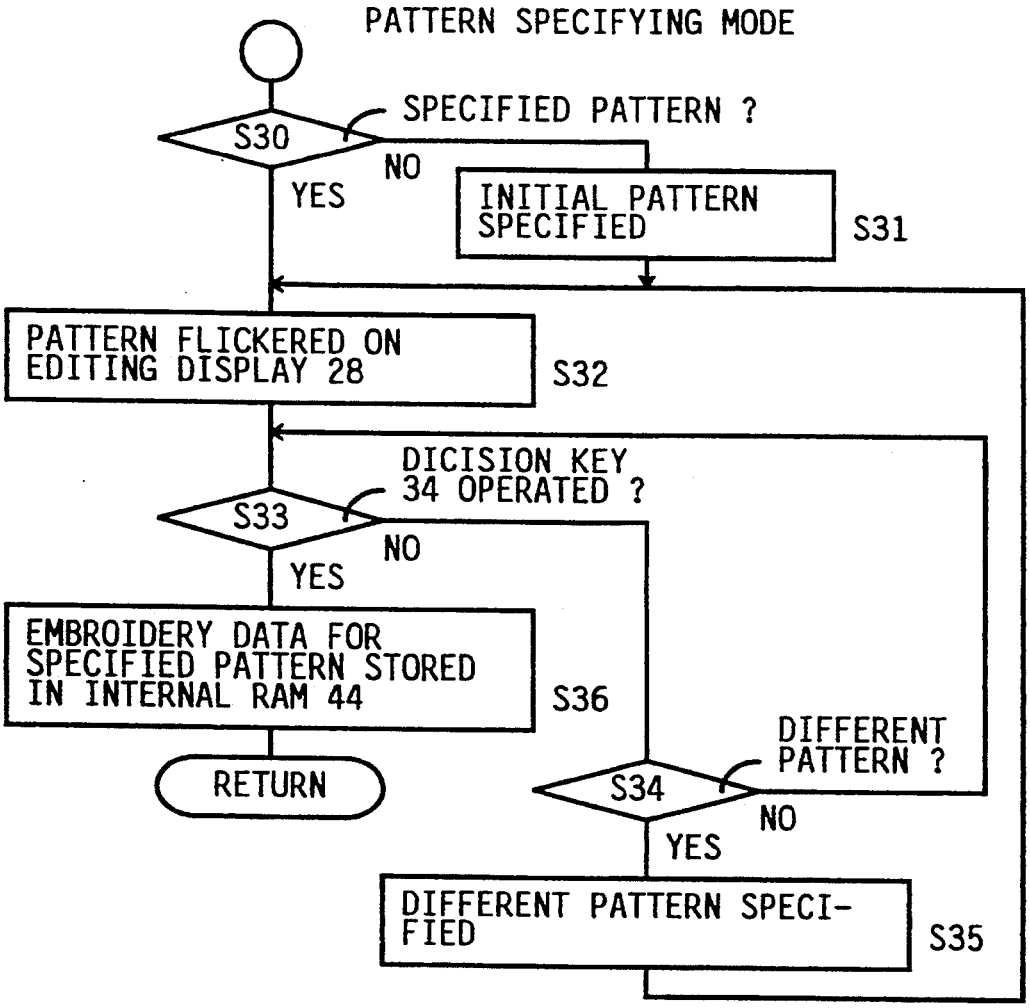
FIG. 7 is a flow chart representing the pattern specifying mode as one of the editing modes of the editing apparatus of FIG. 1.

At Step S30 of FIG. 7, the CPU 22 scans the data stored in the internal RAM 44 for finding a set of embroidery data for an embroidery pattern which has already been specified in a prior cycle of the pattern specifying mode. When a negative judgment is made at Step S30, the control of the CPU 22 goes to Step S31 to scan the data stored in the RAM card 14 for specifying a pattern whose embroidery data have been stored first of all in the RAM card 14. Step S31 is followed by Step S32 to flicker, on the editing display 28, the pattern specified at Step S31.

Step S32 is followed by Step S33 in which the CPU 22 waits for the operator to operate the decision key 34. When the flickering pattern is the pattern to be specified (in the present specific case, pattern to be corrected), the operator operates the decision key 34. However, when the flickering pattern is not the desired pattern, the operator operates an appropriate one of the four cursor-displacing keys 32 for specifying another pattern whose embroidery data are stored in the RAM card 14. In the latter case, a negative judgment is made at Step S33 and a positive judgment is made at Step S34, and therefore at Step S35 the CPU 22 flickers the newly specified pattern on the display 28. More specifically, when the operator operates one of the leftward and upward cursor-displacing keys 32, the CPU 22 specifies a pattern whose embroidery data have been stored in the RAM card 14 immediately before the storage of the data for the currently flickering pattern. Meanwhile, when the operator operates one of the rightward and downward cursor-displacing keys 32, the CPU 22 specifies a pattern whose embroidery data have been stored in the RAM card 14 immediately after the storage of the data for the currently flickering pattern. Thus, at Step S34, the operator can specify any one of the embroidery patterns stored in the RAM card 14.

For changing the incorrect letter "A" out of the misspelled word 'HALLO' to the correct letter —E—, the first specified letter "H" is not the pattern to be corrected, therefore the rightward or downward cursor-displacing key 32 is operated to specify the pattern "A". Then, at Step S32 in the next cycle, the CPU 22 flickers the letter "A". When the operator operates the decision key 34, the CPU 22 makes a positive judgment at Step S33. In this case, the control of the CPU 22 goes to Step S36 to store in the internal RAM 44 data indicating that there is a pattern specified in the pattern specifying mode, in addition to the set of embroidery data for the specified embroidery pattern. Subsequently, the control of the CPU 22 goes back to the main routine of FIG. 5. Before operating the mode-selecting key 58 for placing the editing apparatus 10 out of the pattern specifying mode, the operator may operate the all-pattern erasing key 36 to erase the data stored in the internal RAM 44 at Step S36 in the preceding cycle of the pattern specifying mode. In this case, the control of the CPU 22 goes back to Step S30 to enable the operator to newly specify another pattern. If a predetermined time duration has passed after the data have been stored in the internal RAM 44 at Step S36 in the preceding cycle of the pattern specifying mode, without any operation of the mode-selecting key 58, a positive judgment is made at Step S30 in the next cycle, and the specified pattern whose data are stored in the internal RAM 44 at Step S36 in the preceding cycle, is flickered at Step S32 in the next cycle. In this case, the pattern specified in the preceding cycle may be changed to a pattern newly specified at Steps S33 through S35 in the next cycle.

Figure 6:
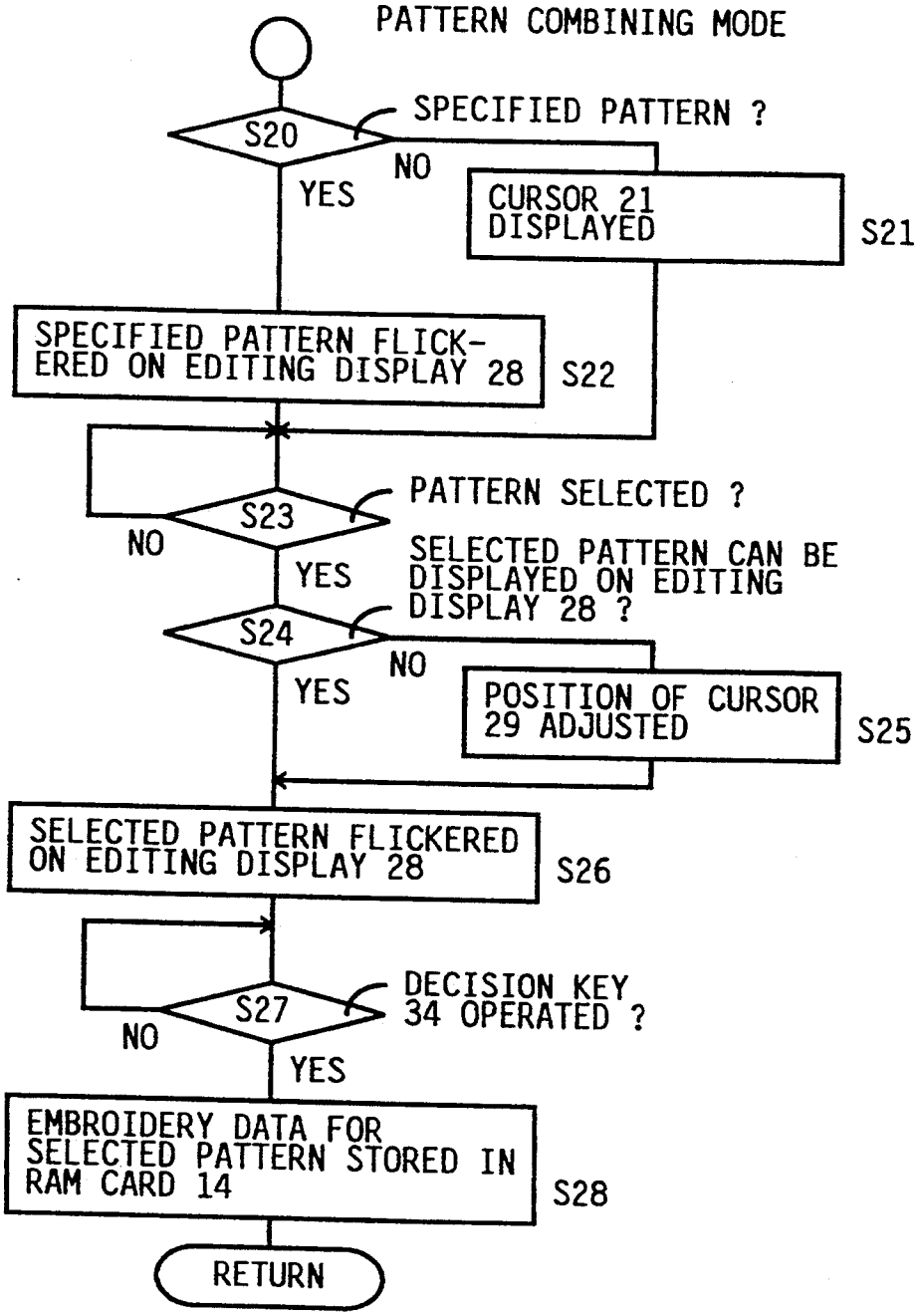
FIG. 6 is a flow chart representing the pattern combining mode as one of the editing modes of the editing apparatus of FIG. 1.

In the event that a pattern to be corrected is specified in the pattern specifying mode and subsequently the mode-selecting key 58 is operated to place the editing apparatus 10 in the pattern combining mode, the CPU 22 identifies at Step S10 that the apparatus 10 is in the pattern combining mode, and at Step S11 the CPU 22 implements the sub-routine of FIG. 6. At Step S20, the CPU 22 scans the data stored in the internal RAM 44 and makes a positive decision as a result of identifying that the stored data include a set of embroidery data for a pattern specified in the pattern specifying mode. The CPU 22 stores in the internal RAM 44 data indicative of the positive result. Then, the control of the CPU 22 goes to Step S22 to flicker on the editing display 28 the specified pattern (e.g., letter "A") at the reference position indicated by the position data stored in the RAM card 14. Step S22 is followed by Step S23 in which, when the operator selects a pattern (e.g., letter "E") by pressing the touch panel 26, the control of the CPU 22 goes to Steps S24 through S27. When at Step S27 the operator operates the decision key 34, the control of the CPU 22 goes to Step S28 to read from the internal RAM 44 the positive result of the judgment of Step S20 and thereby replace, in the RAM card 14, the set of embroidery data for the specified pattern with that for the pattern newly selected at Step S27. For correcting the misspelled word "HALLO", the CPU 22 replaces the data for the pattern "A" with that for the pattern —E—. During this correcting operation, the cursor 29 is not displaced and remains adjacent to the last selected and stored pattern "0" of the word "HELLO". Thus, the present editing apparatus 10 is operable for correcting a combined embroidery patterns stored in the RAM card 14.

Meanwhile, the present editing apparatus 10 is operable for erasing an embroidery pattern from a combined embroidery patterns stored in the RAM card 14. For example, in the event that the operator wishes to correct a misspelled word "HELLOW" to —HELLO— by erasing a letter "W", the operator operates the mode-selecting key 58 to place the editing apparatus 10 in the pattern specifying mode and specify the pattern "W" in the manner described above. Subsequently, the operator operates the mode-selecting key 58 to place the apparatus 10 in the pattern erasing mode. At Step S10 of FIG. 5, the CPU 22 identifies this situation, and at Step S11 the CPU 22 implements the sub-routine of FIG. 8 for the pattern erasing mode.

Figure 8:
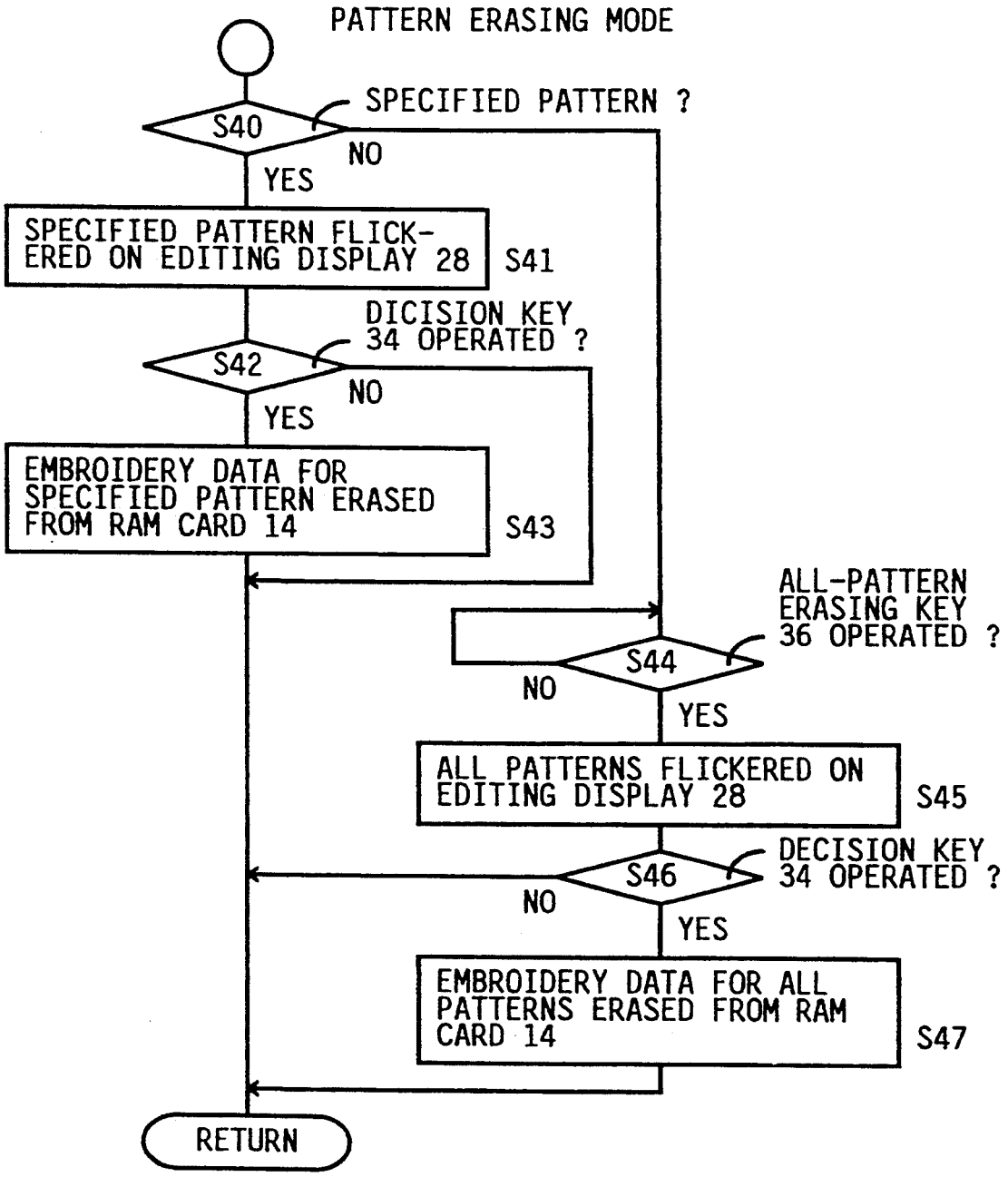
FIG. 8 is a flow chart representing the pattern erasing mode as one of the editing modes of the editing apparatus of FIG. 1.

At Step S40 of FIG. 8, the CPU 22 scans the data stored in the internal RAM 44 and makes a positive judgment by finding the embroidery data for a specified pattern (e.g., letter "W"). Therefore, the control of the CPU 22 goes to Step S41 to flicker on the editing display 28 the specified pattern at the reference position indicated by the position data stored in the RAM card 14.

Step S41 is followed by Step S42 at which the CPU 22 waits for the operator to operate the decision key 34 to erase the flickering pattern. When the operator operates the decision key 34 and a positive judgment is made at Step S42, the control of the CPU 22 goes to Step S43 to erase the embroidery data for the flickering pattern from the RAM card 14. When embroidery patterns are erased one by one from the RAM card 14 and no embroidery pattern is left in the RAM card 14, the cursor 29 is positioned at the left top corner of the editing display 28. On the other hand, if at Step S42 the operator operates any key other than the decision key 34, the control of the CPU 22 goes back to the main routine of FIG. 5, without erasing the embroidery data for the flickering pattern from the RAM card 14.

In the event that the operator wishes to erase all the embroidery patterns stored in the RAM card 14, the mode-selecting key 58 is operated to place the editing apparatus 10 in the pattern erasing mode, without specifying any pattern in advance in the pattern specifying mode. In this event, too, at Step S11 of FIG. 5 the CPU 22 implements the pattern erasing mode according to the sub-routine of FIG. 8. At Step 40 of FIG. 8, however, a negative judgment is made, and the control of the CPU 22 goes to Step S44 at which the CPU 22 waits for the operator to operate the all-pattern erasing key 36. When the operator operates the all-pattern erasing key 36 and a positive judgment is made at Step S44, the control of the CPU 22 goes to Step S45 to flicker on the editing display 28 all the embroidery patterns stored in the RAM card 14. Step S45 is followed by Step S46 at which the CPU 22 waits for the operator to operate the decision key 34 to erase all the embroidery data flickering on the display 28. When the operator operates the decision key 34 and a positive judgment is made at Step S46, the control of the CPU 22 goes to Step S47 to erase all the sets of embroidery data stored in the RAM card 14 and re-position the cursor 29 at the left top corner of the display 28. The CPU 22 further operates for displaying an indication informing the operator that no data is left in the RAM card 14. On the other hand, if at Step S46 the operator operates any key other than the decision key 34, the control of the CPU 22 goes back to the main routine of FIG. 5, without erasing any set of embroidery data from the RAM card 14.

Thus, the editing apparatus 10 is operable for erasing any desired one, or all, of the embroidery patterns stored in the RAM card 14. In the present embodiment, so long as a RAM card 14 is held in the third card holder 11*c*, the control of the CPU 22 can proceed with the main routine of FIG. 5 and operate the apparatus 10 in the pattern erasing mode, even though no ROM card 12 is held in the first or second card holder 11*a*, 11*b*.

For selecting one or more embroidery patterns from the left-hand ROM card 12L held in the first card holder 11*a*, the operator operates the card-selecting key 64 so that the embroidery patterns stored in the left-hand ROM card 12L are displayed on the selection display 24 under control of the CPU 22, as shown in FIG. 10. Even if the currently operative ROM card 12 from which the operator selects one or more embroidery patterns is changed from the left-hand ROM card 12L to the right-hand ROM card 12R, the CPU 22 continues to display the cursor 29 flickering so as to designate a reference position (e.g., position following "0" of the word 'HELLO' as shown in FIG. 10) where a following embroidery pattern selected by the operator is to be located and displayed.

Regarding the example of FIG. 11, the cursor 29 is displaced by the operator to an appropriate position on the editing display 28, and the mode-selecting key 58 is operated to place the editing apparatus 10 in the pattern combining mode in which a desired illustration (e.g., "cat" shown in FIG. 10) is selected and the set of embroidery data for the selected pattern is stored in the RAM card 14. After a desired combined embroidery patterns as shown in FIG. 11 are thus processed on the editing display 28 and a combined sets of embroidery data for the combined embroidery patterns are stored in the RAM card 14, the power switch (not shown) is turned OFF to end the editing operation on the editing apparatus 10.

Figure 12:
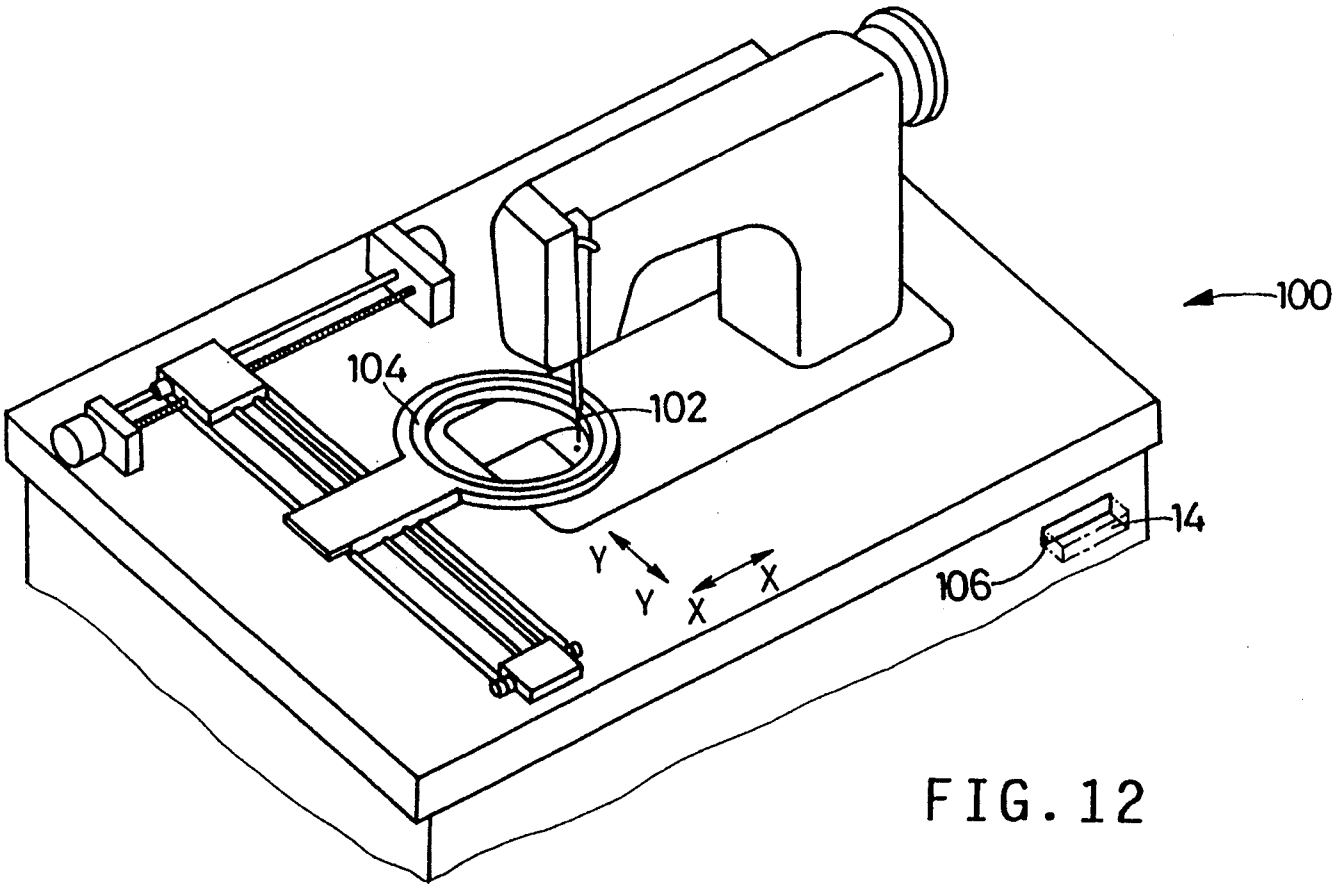
FIG. 12 is a perspective view of a sewing machine including a reading device for reading embroidery data from a ROM card edited by the editing apparatus of FIG. 1.

As is apparent from the foregoing description, the present editing apparatus 10 is operable for selecting a plurality of embroidery patterns from two or more separate ROM cards 12 and storing sets of embroidery data for the selected embroidery patterns into the RAM card 14. Therefore, with the editing apparatus 10, an operator can produce a number of his or her original combined embroidery patterns. Since the thus produced original combined embroidery patterns are stored in a RAM card 14, those embroidery patterns can be used several times. In addition, since the editing apparatus 10 is independent of a sewing machine 100 as shown in FIG. 12, the editing apparatus 10 is operable for producing a combined embroidery patterns, while the sewing machine 100 forms another combined embroidery patterns into a work sheet.

Even though the currently operative ROM card 12 from which one or more embroidery patterns are selected is changed between the two cards 12L and 12R, the cursor 29 continues to designate on the editing display 28 the position of sewing of an embroidery pattern to be next selected by the operator. Thus, the operator can easily establish the sewing position of the next selected pattern relative to the last selected pattern. In addition, since the editing display 28 continues to display one or more patterns selected from the first or prior ROM card 12, the operator can easily see the sewing position of the next pattern selected from the second or current ROM card 12, relative to the pattern or patterns selected from the first ROM card 12. Thus, the operator can easily select and combine two or more patterns from two or more separate ROM cards 12 and design the layout of the Combined embroidery patterns.

In addition, since the editing apparatus 10 is capable of simultaneously holding two separate ROM cards 12, the editing apparatus 10 contributes to saving an operator from the work of replacing two ROM cards 12 with one another.

Since the editing apparatus 10 is operable for combining two or more embroidery patterns selected from two or more separate ROM cards 12 and storing them in a RAM card 14, it is possible that only embroidery patterns which are often used, such as operator's own names and favorite patterns, be stored in one or more ROM cards 12. In this case, the number of the embroidery patterns from which desired patterns are selected is decreased, and the time necessary for selecting the desired patterns is reduced. Therefore, the work efficiency is improved.

As shown in FIG. 12, the RAM card 14 is removable from the editing apparatus 10 and can be inserted in the sewing machine 100, which has a reading device 106 for reading a combined sets of embroidery data stored in the RAM card 14 and a controller (not shown) for moving a sewing needle 102 and a work sheet-supporting holder 104 relative to each other according to the read sets of embroidery data and thereby forming the corresponding combined embroidery patterns on a work sheet supported by the holder 104. The thus formed combined embroidery patterns correspond to those which had been displayed on the editing display 28 of the editing apparatus 10.

While in the illustrated embodiment the editing apparatus 10 is used for selecting embroidery patterns from ROM cards 12 which store sets of embroidery data each set of which includes pattern image data, sewing control data and other control data, it is possible to adapt the editing apparatus 10 to select patterns from ROM cards which stores sets of pattern data which are produced by using an image scanner. The pattern data may be (a) embroidery outline data representative of the outline of an embroidery pattern to be filled with stitches, as disclosed in U.S. Pat. No. 5,191,536, or (b) point data representative of a series of points on a line defining an embroidery pattern to be filled with stitches, as disclosed in U.S. patent application Ser. No. 07/695,582, the Notice of Allowance has been indicated.

Although in the illustrated embodiment two liquid-crystal displays are used as the selection display 24 and the editing display 28, respectively, it is possible to use a single display as both the selection and editing displays 24, 28. In either case, a display which has been employed in a sewing machine may be used as the selection display 24 or the selection and editing display (24, 28).

Since the operator may be familiar with the display employed in the sewing machine, he or she can easily operate the selection display 24 or selection and editing display (24, 28) of the editing apparatus 10.

In addition, it is possible to adapt the selection display 24 to simultaneously display the embroidery patterns stored in both the ROM cards 12L and 12R, so that the operator may select two or more patterns from the patterns displayed on the display 24. In this case, the editing apparatus 10 does not need a device including the key 64 for selecting one of the two ROM cards 12L, 12R.

While the touch panel 26 is used for selecting embroidery patterns, it is possible to use other selecting devices such as a keyboard, a light pen, or a mouse. In particular, the use of a mouse is advantageous for shortening the time necessary for selecting embroidery patterns.

Figure 13:
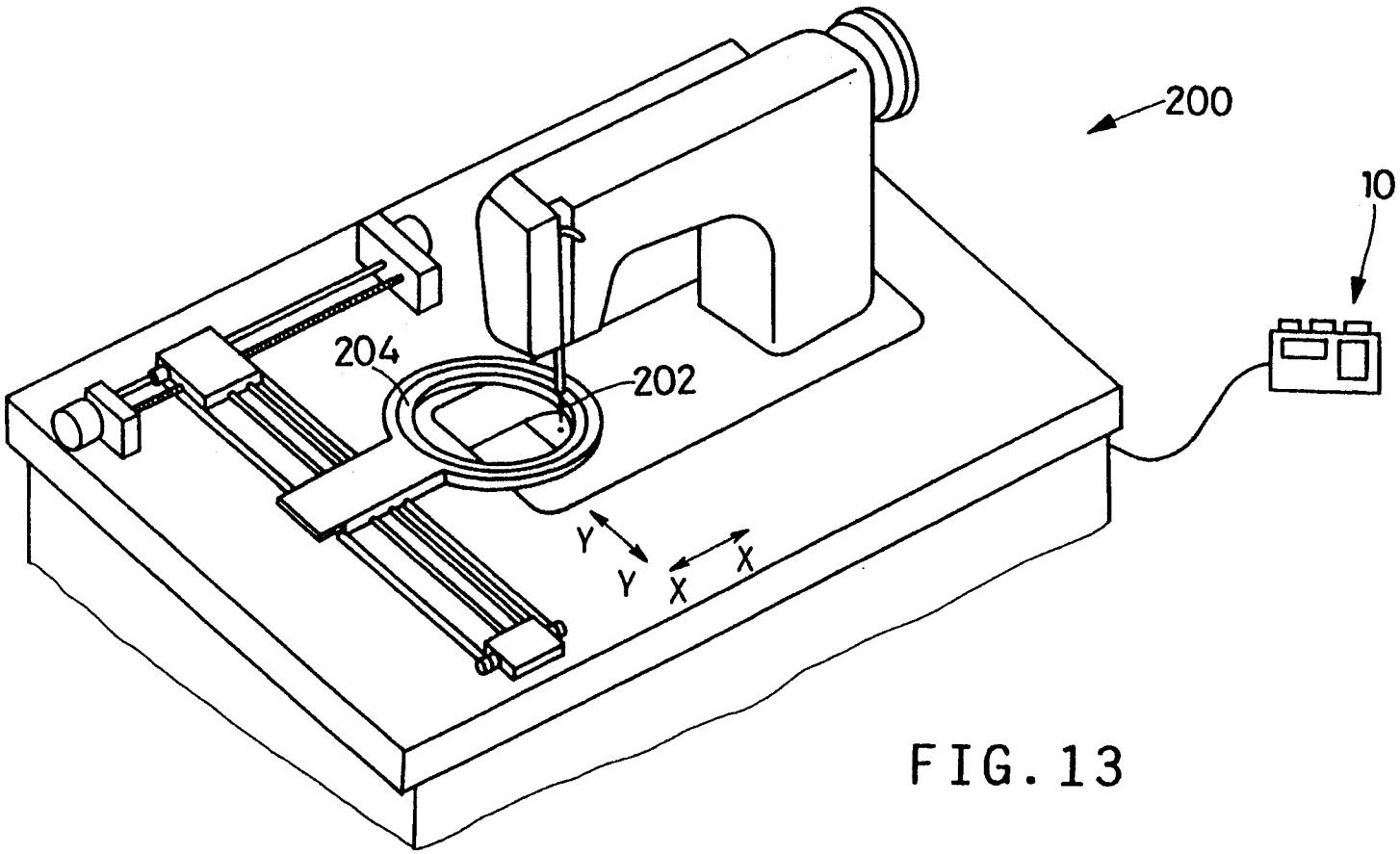
FIG. 13 is a perspective view of a sewing system including a sewing machine and the editing apparatus of FIG. 1 connected to the sewing machine.

As shown in FIG. 13, it is possible to adapt the editing apparatus 10 to be directly connectable with a sewing machine 200 including a sewing needle 202 and a work-sheet holder 204. With the editing apparatus 10 being connected to the sewing machine 200, a combined sets of embroidery data (including sewing control data and other control data) edited by the editing apparatus 10 are directly fed through a cable to the sewing machine 200. In this case, the operator does not need to remove the RAM card 14 from the editing apparatus 10 or insert it in the sewing machine 200, unlike the embodiment shown in FIG. 12. In addition, the transmission of the embroidery data can be completed in a shorter time, thereby improving the work efficiency. Alternatively, the embroidery data may be transferred by radio from the editing apparatus 10 to the sewing machine 200.

Furthermore, it is possible to incorporate the editing apparatus 10 into a sewing machine, so that the embroidery data processed by the editing apparatus 10 can directly be utilized by the sewing machine. In this case, immediately after the embroidery data have been edited by the editing apparatus, the sewing machine can start sewing operation according to the processed embroidery data.

Moreover, the editing apparatus 10 may be adapted to simultaneously hold three or more ROM cards 12, so as to save the work of changing the ROM cards 12 with one another.

While the editing apparatus 10 has the three editing modes, i.e., pattern combining mode, pattern specifying mode, and pattern erasing mode, it is possible to adapt the apparatus 10 to be operable in one or more additional editing modes, such as a pattern displacing mode and a pattern copying mode. In the pattern displacing mode which is selectable by operating the mode-selecting key 58, an embroidery pattern specified in the pattern specifying mode of FIG. 7 may be displaced on the editing display 28 to a new position-designated by the cursor 29. In the pattern copying mode which is selectable by operating the mode-selecting key 58, an embroidery pattern specified in the pattern specifying mode of FIG. 7 may be copied and located at a position designated by the cursor 29 on the editing display 28.

While the present invention has been described in its preferred embodiments, it is to be understood that the present invention may be embodied with other changes, improvements and modifications that may occur to those skilled in the art without departing from the scope and spirit of the invention defined in the appended claims.

What is claimed is:

1. An embroidery pattern processing apparatus comprising:

a reading device which reads a plurality of sets of embroidery data from a plurality of external memories, each of said sets of embroidery data defining an embroidery pattern to be formed by a sewing machine;

a selection display which displays said embroidery pattern of said each set of embroidery data read by said reading device;

a manually operable selecting device for selecting a plurality of embroidery patterns from the embroidery patterns displayed on said selection display, said selecting device including a manually operable pattern-specifying member for specifying one of the embroidery patterns displayed on said selection display so that said selecting device selects said one embroidery pattern specified by said pattern-specifying member; and a writing device which writes, in an embroidery pattern memory, the sets of embroidery data for the embroidery patterns selected by said selecting device from said external memories.

2. The processing apparatus as set forth in claim 1, wherein said reading device reads from said external memories said each set of embroidery data comprising pattern image data representative of said embroidery pattern, said selection display displaying said embroidery pattern represented by said pattern image data of said each set of embroidery data.

3. The processing apparatus as set forth in claim 1, wherein said reading device comprises a plurality of memory holders each of which holds a corresponding one of said external memories such as a read-only-memory card.

4. The processing apparatus as set forth in claim 3, wherein said reading device further comprises a manually operable member for selecting one of said external memories held by said memory holders, said selection display displaying the embroidery pattern of at least one set of embroidery data read by said reading device from the selected one of said external memories.

5. The processing apparatus as set forth in claim 1, wherein said reading device comprises a memory holder which holds one of said external memories, and a memory which stores the sets of embroidery data read by said reading device from said one of said external memories.

6. The processing apparatus as set forth in claim 1, wherein said writing device comprises a memory holder which holds, as said embroidery pattern memory, an external memory such as a random-access-memory card, said writing device writing in said external memory the sets of embroidery data selected by said selecting device.

7. The processing apparatus as set forth in claim 1, wherein said pattern-specifying member of said selecting device comprises a pressure-sensitive panel provided on said selection display, said panel permitting an operator to see, through the panel, the embroidery patterns displayed on said selection display and enabling the operator to select one of the displayed embroidery patterns by pressing a corresponding portion of the panel.

8. The processing apparatus as set forth in claim 1, further comprising a manually operable editing device for editing the embroidery patterns selected by said selecting device from said external memories.

9. The processing apparatus as set forth in claim 8, wherein said editing device comprises:

an editing display which displays the embroidery patterns selected by said selecting device from said external memories;

a cursor which is displaceable on said editing display to designate a position where a selected embroidery pattern is to be located; and a manually operable cursor-displacing member for displacing said cursor on said editing display.

10. The processing apparatus as set forth in claim 9, wherein said writing device writes, in said embroidery pattern memory, sets of position data indicative of the positions where the embroidery patterns selected by said selecting device are located on said editing display, in addition to the sets of embroidery data for the selected embroidery patterns.

11. The processing apparatus as set forth in claim 10, wherein said editing display displays the embroidery patterns represented by the sets of embroidery data written in said embroidery pattern memory, at the respective positions indicated by the sets of position data written in the embroidery pattern memory.

12. The processing apparatus as set forth in claim 8, wherein said editing device comprises a manually operable all-pattern-erasing member for erasing, from the embroidery pattern memory, all the sets of embroidery data representing the embroidery patterns selected by said selecting device.

13. The processing apparatus as set forth in claim 9, wherein said editing device further comprises a manually operable pattern-specifying member for specifying one of the embroidery patterns displayed on said editing display.

14. The processing apparatus as set forth in claim 9, wherein said editing device further comprises a manually operable pattern-erasing member for erasing, from the embroidery pattern memory, a set of embroidery data for a specified one of the embroidery patterns displayed on said editing display.

15. The processing apparatus as set forth in claim 9, wherein said editing device further comprises a manually operable pattern-replacing member for replacing, in the embroidery pattern memory, a set of embroidery data for a specified one of the embroidery patterns displayed on said editing display, with a set of embroidery data for an embroidery pattern selected by said selecting device from the embroidery patterns displayed on said selection display.

16. The processing apparatus as set forth in claim 9, wherein said editing device further comprises a manually operable pattern-displacing member for displacing a specified one of the embroidery patterns displayed at the position thereof on said editing display, to a desired, new position on the editing display.

17. The processing apparatus as set forth in claim 9, wherein said editing device further comprises a manually operable mode-selecting member for placing the editing apparatus in one of a plurality of predetermined operating modes.

18. The processing apparatus as set forth in claim 9, wherein said editing display comprises a number of unit display areas, said cursor designating one of said unit display areas.

19. The processing apparatus as set forth in claim 18, wherein said editing device comprises a manually operable changing device for changing a size of an embroidery pattern selected by said selecting device from the embroidery patterns displayed on said selection display, said editing display displaying the selected embroidery pattern in the changed size.

20. The processing apparatus as set forth in claim 19, wherein said editing device comprises adjusting means for, when a size of an embroidery pattern selected by said selecting device is greater than a size of the unit display area designated by said cursor, displacing said cursor to a position where the selected embroidery pattern is displayed in the size thereof on said editing display without overlapping any embroidery patterns displayed on the editing display.

21. The processing apparatus as set forth in claim 9, wherein said writing device writes, in the embroidery pattern memory, a plurality of batches of combined embroidery pattern data, each of said batches of combined embroidery pattern data representing combined embroidery patterns simultaneously displayed on said editing display.

22. A sewing system comprising:

(A) an embroidery pattern processing apparatus including:

a reading device which reads a plurality of sets of embroidery data from a plurality of external memories, each of said sets of embroidery data defining an embroidery pattern to be formed by a sewing machine;

a selection display which displays the embroidery pattern of said each set of embroidery data read by said reading device;

a manually operable selecting device for selecting a plurality of embroidery patterns from the embroidery patterns displayed on said selection display, said selecting device including a manually operable pattern-specifying member for specifying one of the embroidery patterns displayed on said selection display so that said selecting device selects said one embroidery pattern specified by said pattern-specifying member;

a writing device which writes, in an embroidery pattern memory, the sets of embroidery data for the embroidery patterns selected by said selecting device from said external memories; and (B) a sewing machine which forms the selected embroidery patterns according to the sets of embroidery data written in the embroidery pattern memory.

23. The sewing system as set forth in claim 22, wherein said pattern-specifying member of said selecting device comprises a pressure-sensitive panel provided on said selection display, said panel permitting an operator to see, through the panel, the embroidery patterns displayed on said selection display and enabling the operator to select one of the displayed embroidery patterns by pressing a corresponding portion of the panel.

24. An embroidery pattern processing apparatus comprising:

a reading device which reads a plurality of sets of embroidery data from a plurality of external memories, each of said sets of embroidery data defining an embroidery pattern to be formed by a sewing machine, said reading device comprising a plurality of memory holders each of which holds a corresponding one of said external memories;

a selection display which displays said embroidery pattern of said each set of embroidery data read by said reading device;

a manually operable selecting device for selecting a plurality of embroidery patterns from the embroidery patterns displayed on said selection display; and a writing device which writes, in an embroidery pattern memory, the sets of embroidery data for the embroidery patterns selected by said selecting device from said external memories.

25. The processing apparatus as set forth in claim 24, wherein each of said memory holders of said reading device holds a read-only-memory card as one of said external memories.

26. The processing apparatus as set forth in claim 24, wherein said reading device further comprises a manually operable member for selecting one of said external memories held by said memory holders, said selection display displaying the embroidery pattern of at least one set of embroidery data read by said reading device from the selected one of said external memories.

27. The processing apparatus as set forth in claim 24, wherein said writing device comprises a memory holder which holds an external memory as said embroidery pattern memory, said writing device writing in said external memory the sets of embroidery data selected by said selecting device.

28. An embroidery pattern processing apparatus comprising:

a reading device which reads a plurality of sets of embroidery data from a plurality of external memories, each of said sets of embroidery data defining an embroidery pattern to be formed by a sewing machine;

a selection display which displays said embroidery pattern of said each set of embroidery data read by said reading device;

a manually operable selecting device for selecting a plurality of embroidery patterns from the embroidery patterns displayed on said selection display; and a writing device which writes, in an embroidery pattern memory, the sets of embroidery data for the embroidery patterns selected by said selecting device from said external memories, said writing device comprising a memory holder which holds an external memory as said embroidery pattern memory, said writing device writing in said external memory the sets of embroidery data selected by said selecting device.

29. The processing apparatus as set forth in claim 28, wherein said memory holder of said writing device holds a random-access-memory card as said external memory.

30. An embroidery pattern processing apparatus comprising:

a reading device that reads a plurality of sets of embroidery data from a plurality of external memories, each of said sets of embroidery data defining an embroidery pattern to be formed by a sewing machine;

a selection display that displays said embroidery pattern of said each set of embroidery data read by said reading device;

a manually operable selecting device for selecting a plurality of embroidery patterns from the embroidery patterns displayed on said selection display;

a writing device which writes, in an embroidery pattern memory, the sets of embroidery data for the embroidery patterns selected by said selecting device from said external memories; and a manually operable editing device for editing the embroidery patterns selected by said selecting device from said external memories, said editing device including (a) an editing display which displays the embroidery patterns selected by said selecting device from said external memories; and (b) a manually operable pattern-specifying member for specifying one of the embroidery patterns displayed on said editing display so that said editing device edits the set of embroidery data for said one embroidery pattern specified by said pattern-specifying member; said writing device writing, in said embroidery pattern memory, the edited set of embroidery data for said one embroidery pattern.

31. The processing apparatus as set forth in claim 30, wherein said manually operable pattern-specifying member of said editing device comprises:

a cursor which is displaceable on said editing display to designate a position where a selected embroidery pattern is to be located; and a manually operable cursor-displacing member for displacing said cursor on said editing display.

32. The processing apparatus as set forth in claim 30, wherein said editing device further comprises a manually operable all-pattern-erasing member for erasing, from the embroidery pattern memory, all the sets of embroidery data for the embroidery patterns selected by said selecting device.

33. The processing apparatus as set forth in claim 30, wherein said editing device further comprises at least one of (a) a manually operable pattern-erasing member for erasing, from the embroidery pattern memory, the set of embroidery data for the specified one of the embroidery patterns displayed on said editing display; (b) a manually operable pattern-replacing member for replacing, in the embroidery pattern memory, the set of embroidery data for the specified one of the embroidery patterns displayed on said editing display, with a set of embroidery data for an embroidery pattern selected by said selecting device from the embroidery patterns displayed on said selection display; and (c) a manually operable pattern-displacing member for displacing the specified one of the embroidery patterns displayed at a position thereof on said editing display, to a desired, new position on the editing display.

34. The processing apparatus as set forth in claim 30, wherein said selecting device comprises a manually operable pattern-specifying member for specifying one of the embroidery patterns displayed on said selection display so that said selecting device selects said one embroidery pattern specified by said pattern-specifying member.

35. The processing apparatus as set forth in claim 30, wherein said reading device comprises a plurality of memory holders each of which holds a corresponding one of said external memories.

36. The processing apparatus as set forth in claim 30, wherein said writing device comprises a memory holder which holds an external memory as said embroidery pattern memory, said writing device writing in said external memory the sets of embroidery data selected by said selecting device.

* * * * *